United States Patent [19]

Miner, Jr.

[11] Patent Number: 4,541,321

[45] Date of Patent: Sep. 17, 1985

[54] HARMONICA-TO-MICROPHONE ATTACHMENT DEVICE

[76] Inventor: Robert J. Miner, Jr., 1429 Fewel St., El Paso, Tex. 79902

[21] Appl. No.: 547,336

[22] Filed: Oct. 31, 1983

[51] Int. Cl.[4] ..... G10D 7/12

[52] U.S. Cl. ..... 84/379; 84/1.04; 84/DIG. 14

[58] Field of Search ..... 84/DIG. 14, 1.14, 378, 84/379, 1.04, 1.06

[56] References Cited

U.S. PATENT DOCUMENTS

| | | | |
|---|---|---|---|
| 4,091,704 | 5/1978 | Moe | 84/378 |
| 4,397,213 | 8/1983 | Hubbard | 84/379 |
| 4,497,234 | 2/1985 | Strnad | 84/1.04 |

*Primary Examiner*—Forester W. Isen

[57] ABSTRACT

A harmonica support clamp which attaches any standard harmonica to any standard vocalist-type stand-held microphone. Which harmonica support clamp comprising a hollow, one-piece extruded plastic body open at both ends and with two juxtaposed harmonica-clamping edges; each of which harmonica-clamping edges extends the length of an attached clamping side wall and is formed simultaneously with and as a part of the associated clamping side wall; and between which harmonica-clamping edges a harmonica is receivable. Each clamping side wall is a continuation of a common central base wall. The harmonica support clamp also comprising as an integral part of its construction a pair of microphone-mounting-brace clamps on the inside surface of the central base wall; into which microphone-mounting-brace clamps two generally L-shaped microphone-mounting braces are inserted via a microphone insertion opening which microphone insertion opening is formed through the central base wall; and into which microphone insertion opening a microphone is receivable. An adjustable sleeve clamp receivable over the microphone-mounting braces secures the microphone-mounting braces, and thereby the entire harmonica support clamp, to the microphone.

3 Claims, 8 Drawing Figures

HARMONICA-TO-MICROPHONE ATTACHMENT DEVICE

BACKGROUND OF THE INVENTION

The present invention/product relates to holders for harmonicas which enable a musician to play a harmonica while simultaneously performing on another hand-operated instrument such as piano, organ, guitar, bass guitar, drums, etc. U.S. patents issued for such devices fall into two categories: (1) The harness-type harmonica holder typified by U.S. Pat. No. 3,172,328 of Mar. 9, 1965 issued to E. Haile, and (2) the harmonica stand, U.S. Pat. No. 4,212,219 issued July 15, 1980 to D. Hubbard.

Devices such as those similar to the Haile harmonica holder, U.S. Pat. No. 3,172,328, are ordinarily suspended from around the musician's neck and have the problem of impeding not only the general movements of the performer, but more importantly, impeding the performer's ability to achieve levels of musical virtuosity similar to the levels of virtuosity attainable by the same player when holding the harmonica by hand. The primary reasons for these impediments are that the neck harness-type harmonica holders are rigidly set to a horizontal axis which is difficult for the performer to modify without some degree of undesirable physical contortion and which horizontal axis is often not sufficiently similar to the preferred individually distinctive horizontal axis of the harmonica and the resulting mouth-to-harmonica alignment which naturally occurs when the harmonica is hand-held by the performer. Further, the impediments to general mobility and attainable virtuosity exist because the neck harness-type harmonica holder attaches the harmonica to the performer's body, and thus the harmonica tends to move slightly ahead of the player as the player moves the mouth and head to the right and left while playing the various harmonica's pitches. This characteristic tendency inherent to the neck harness-type harmonica holder greatly limits the speed and accuracy with which the player can perform on the harmonica. This limitation is especially noticeable during the performance of styles or interpretations that are melodic rather than chordal in their musical nature. For many players, this renders the neck harness-type harmonica holders unusable in the performance of their preferred styles of music. Also, such harness type devices do not allow the performer to acquire the stylistically desirable tonal-timbre characteristics which are obtained when a harmonica is held closely to a microphone in a cupped hand or other semi-enclosure, and which sounds are the preferred sounds among performers of styles of music that are characteristically electronically amplified and/or electronically processed.

Moreover, the prior art of the Hubbard harmonica stand, U.S. Pat. No. 4,212,219 of July 15, 1980, attempts to solve some of the deficiencies stated above, but in the attempt involves the manufacture of numerous separate parts which are subsequently fitted together into an entire microphone stand assemly as well as a harmonica mounting assembly, which harmonica mounting assembly alone comprises more than thirty separate parts. This has the disadvantage of being less economical to manufacture than is the present invention/product. A further disadvantage with the prior art disclosed in U.S. Pat. No. 4,212,219 is that the harmonica mounting assembly, along with its attached microphone, are not readily disattachable from and reattachable to the microphone stand, thus restricting the performer to a stand-held use of the device which limits the creative staging options available to the performer. A still further and considerable disadvantage with the prior art of U.S. Pat. No. 4,212,219 is in the solution to the problem of satisfying the necessity for rapid replacement of harmonicas, which rapid replacement is essential to performance due to commonly frequent changes in musical keys and styles of playing. As is referenced in U.S. Pat. No. 4,212,219, column 1, lines 63 through 66, the rapid replacement of harmonicas in the use of said prior art device requires that the user of the device "have a number of harmonicas clamped in seats" and further specifies that rapid replacement is accomplished by reason of a wing nut and an associated slot for replacing seat assemblies and the harmonicas attached thereto. Such a solution is inefficient in cost to the user and presents the user with greater difficulty in use than does the solution afforded by the one-piece, multipurpose body of the present invention/product. The present invention is distinguished from all other types of harmonica holders in that it provides for: (1) greater freedom of motion and more options for creative staging for the performer through either hand-held or stand-held application; (2) flexibility in the setting of both horizontal and vertical pivoting axes, thus allowing the performer to duplicate the mouth-to-harmonica alignments most comfortable to the performer, and thus providing the performer with greater potential to attain levels of virtuosity similar to those attainable by the same performer when hand-holding the harmonica; (3) the attaching of a harmonica to any of the majority of existent standard vocalist-type microphones and microphone stand assemblies; (4) production of unique and desirable tonal-timbre characteristics; (5) economical manufacture due to a one-piece body design and a three-piece attachment assembly; (6) great ease in rapid replacement or changing of harmonicas by reason of a harmonica clamping slot which can be operated easily by both left-handed and right-handed users, and which harmonica clamping slot is an integral part of the unique design of the one-piece body of the present invention/product.

OBJECTS OF THE INVENTION

It is an object of this invention/product to provide a holder for a harmonica which will attach a standard harmonica to any of the standard vocalist-type microphones standard microphone stand assemblies, thus enabling a musician to perform on an electronically amplified harmonica while simultaneously performing on any other hand-operated instrument.

It is a further object of this invention/product to provide a holder for a harmonica which will attach a harmonica to a microphone and whatever microphone stand assembly in such a way that will allow the performer to remove, at the performer's option, the microphone and attached harmonica from the microphone stand for the purpose of hand-holding rather than stand-holding the harmonica-to-microphone assembly during performance; and also to allow, at the performer's option, the replacing of the microphone and attached harmonica back onto the microphone stand for hand-free stand-holding of the harmonica-to-microphone assembly.

It is a further object of this invention/product to provide a holder which will attach a harmonica to a microphone in such a way that will prevent the sound distortions that can result from nasal exhalations into the microphone; and at the same time to provide a method of attaching a harmonica closely to the microphone in a way that places the harmonica resonating chamber openings and the sensing device of the microphone together on the inside of a reflective semi-enclosure in order to allow for the production of numerous of the tonal-timbre characteristics which are among the preferred sounds of performers of styles of music which styles are characteristically electronically amplified and/or electronically processed.

It is further an object of this invention/product to provide a holder for a harmonica which attaches a harmonica to a microphone in such a way that allows for fully and easily alterable pivoting of the harmonica on both the horizontal and vertical axes in order to provide the performer with whatever mouth-to-harmonica alignment is most natural and comfortable to the performer.

It is further an object of this invention/product to provide for easy and rapid replacement or changing of harmonicas during use of the device, and further to provide for the same ease and efficiency of use for both right-handed and left-handed users.

Other objects of this invention/product are to provide a device which accomplishes all of the above-listed objects in such a way that is simple in design, economical to manufacture, generally easy to use, and durable.

SUMMARY OF THE INVENTION

In satisfying the objects and intentions of this invention, I provide a one-piece rigid but semiflexible harmonica clamp, preferably formed from extruded plastic or similar process and material, which harmonica clamp being approximately the same length as the body of a harmonica and which harmonica clamp is open at both ends and is of such shape and thickness so as to securely hold in place a harmonica, which harmonica is receivable between two parallel juxtaposed harmonica-clamping edges. Each of which harmonica clamping edges being supported by and being a continuation of a clamping side wall; which clamping side walls are supported by and are a continuation of a single central base wall. The clamping side wall and the central base wall serve as both a clamping device to hold the harmonica in place and a windshield to prevent nasal exhalations from reaching the microphone. Through the central base wall a microphone insertion opening is formed, through which microphone insertion opening the handle of a microphone is receivable. Lengthwise on the inside bottom surface of the central base wall are formed a pair of microphone-mounting-brace clamps into which microphone-mounting-brace clamps are inserted two generally L-shaped microphone-mounting braces, one each into each of two opposite sides of the microphone insertion opening. The microphone-mounting braces, which are formed preferably from bent strapping metal or similar material as is common to commerce, are in turn held securely to the microphone handle with a standard hose clamp or similar clamping device as is common to commerce. The present invention/product, forms a harmonica-to-microphone attachment assembly which assembly is in turn inserted into the microphone holder of whatever appropriate microphone stand assembly. Further, the present invention/product provides the user with control in obtaining whatever mouth-to-harmonica alignment is preferred by the user, which mouth-to-harmonica alignment is obtained by reason of the unimpeded allowance for utilization of the normal pivoting axes as are existent in most microphone to microphone holder relationships and existent in such microphone holders and microphone stand assemblies as are common to commerce.

A BRIEF DESCRIPTION OF THE DRAWINGS

Figure 5:
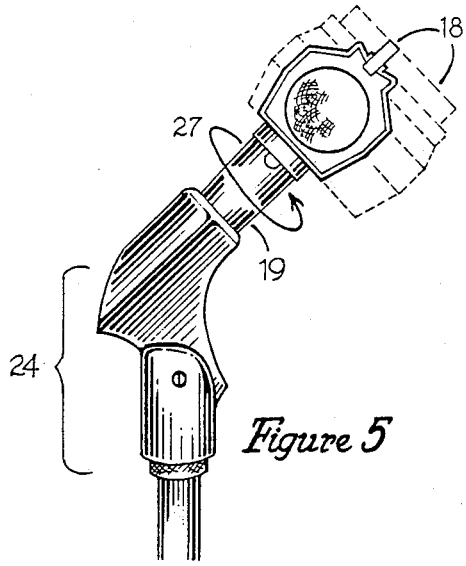
Figure 6:
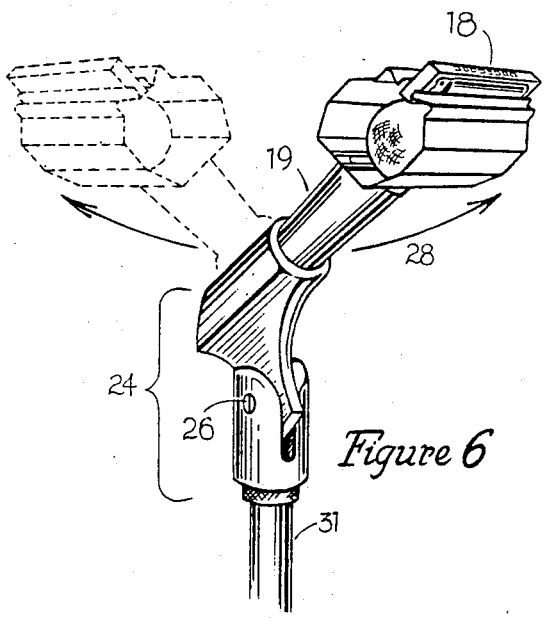
Figure 7:
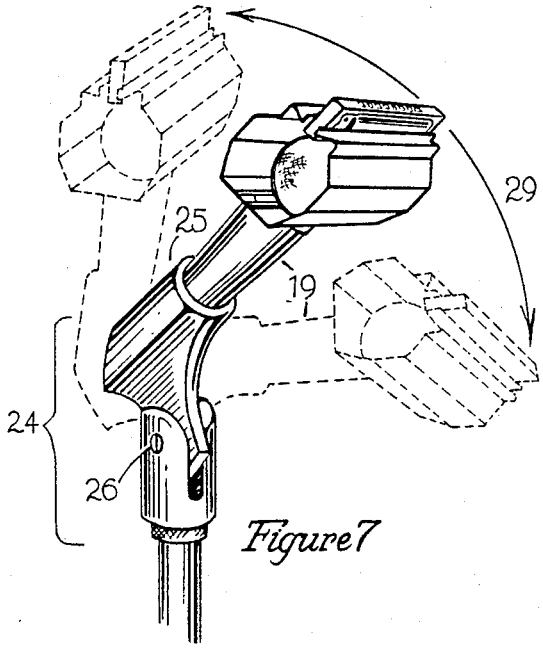

FIG. 5, FIG. 6, and FIG. 7 are views in perspective of the entire harmonica-to-microphone assembly inserted into a standard type microphone holder. Further, FIG. 5 illustrates the horizontal pivoting axis; FIG. 6 illustrates the left-to-right circular pivoting axis; and FIG. 7 illustrates the vertical pivoting axis of a harmonica when supported with the present invention as depicted.

Figure 8:
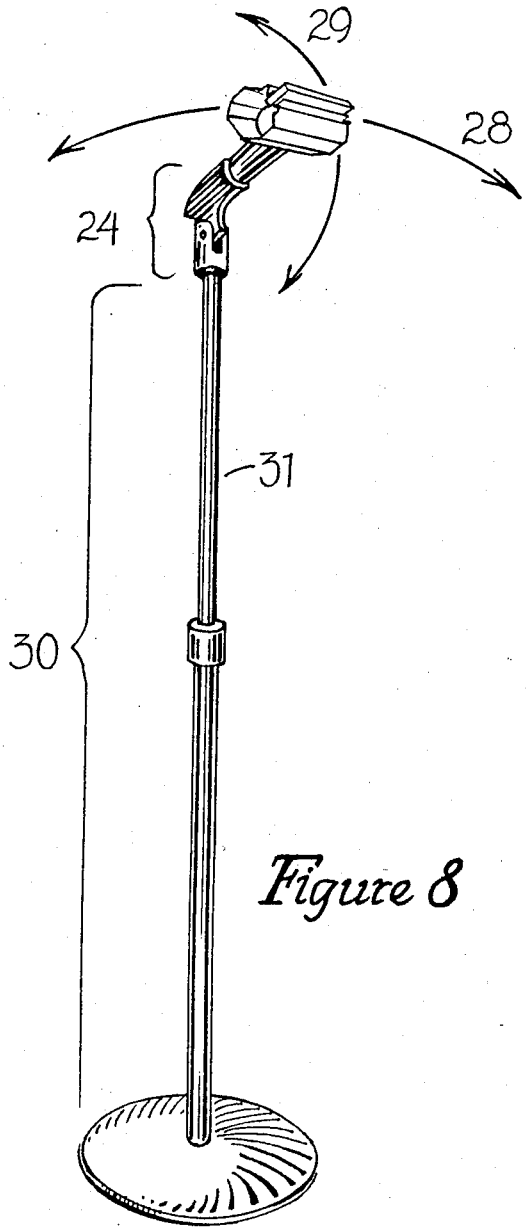

FIG. 8 is a view in perspective of the entire harmonica-to-microphone assembly inserted into a typical microphone holder on a microphone stand assembly of a variety that is common to commerce. Further, the diagram illustrates both the left-to-right pivoting axis and the vertical pivoting axis of a harmonica when supported by the present invention in the manner depicted.

DESCRIPTION OF THE PREFERRED EMBODIMENT

Figure 1:
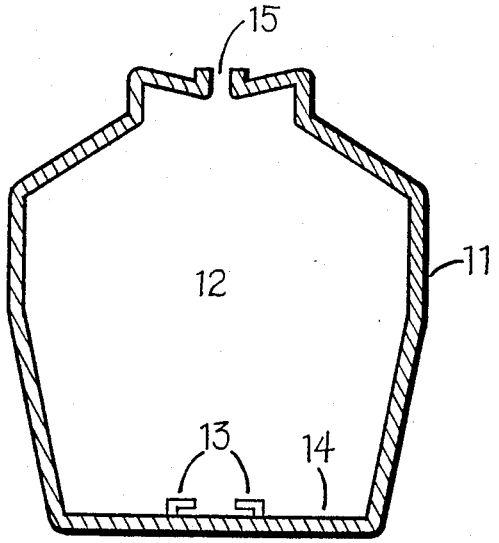
FIG. 1 is an orthographic end view of the harmonica clamp showing the harmonica-clamping eges, the clamping side walls, the central base wall, and the microphone-mounting-brace clamps.
Figure 2:
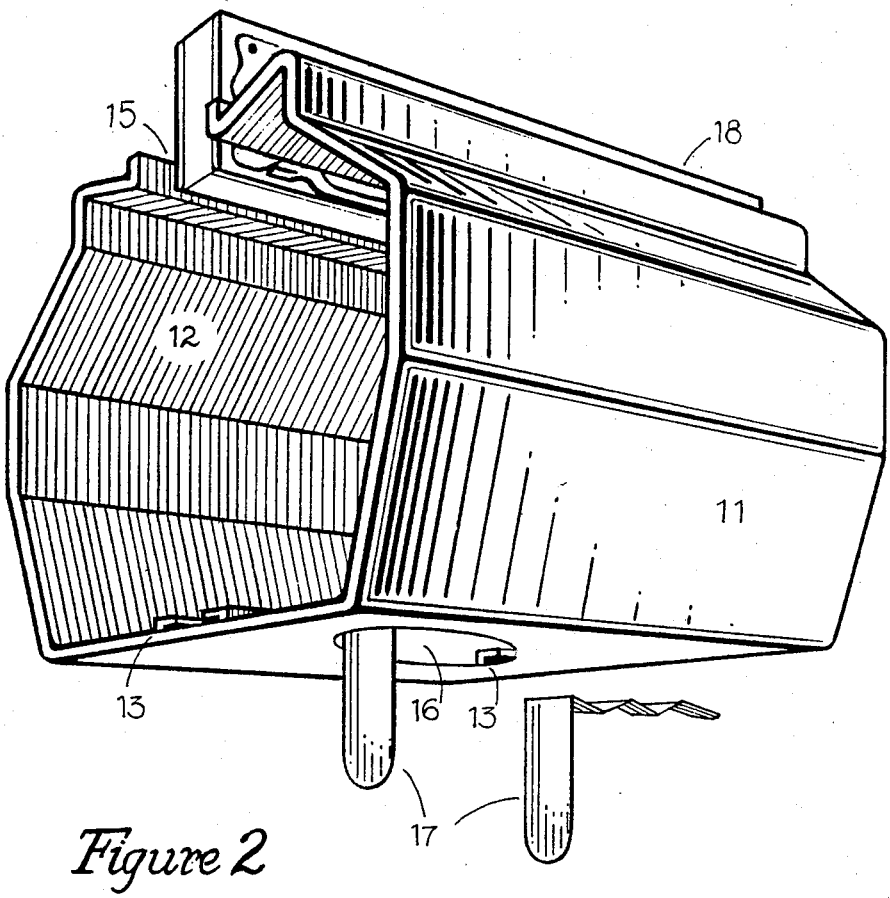
FIG. 2 is a view in perspective of the the invention showing the harmonica inserted between the harmonica-clamping edges; the two microphone-mounting braces, one inserted and one uninserted; and the microphone insertion opening.
Figure 3:
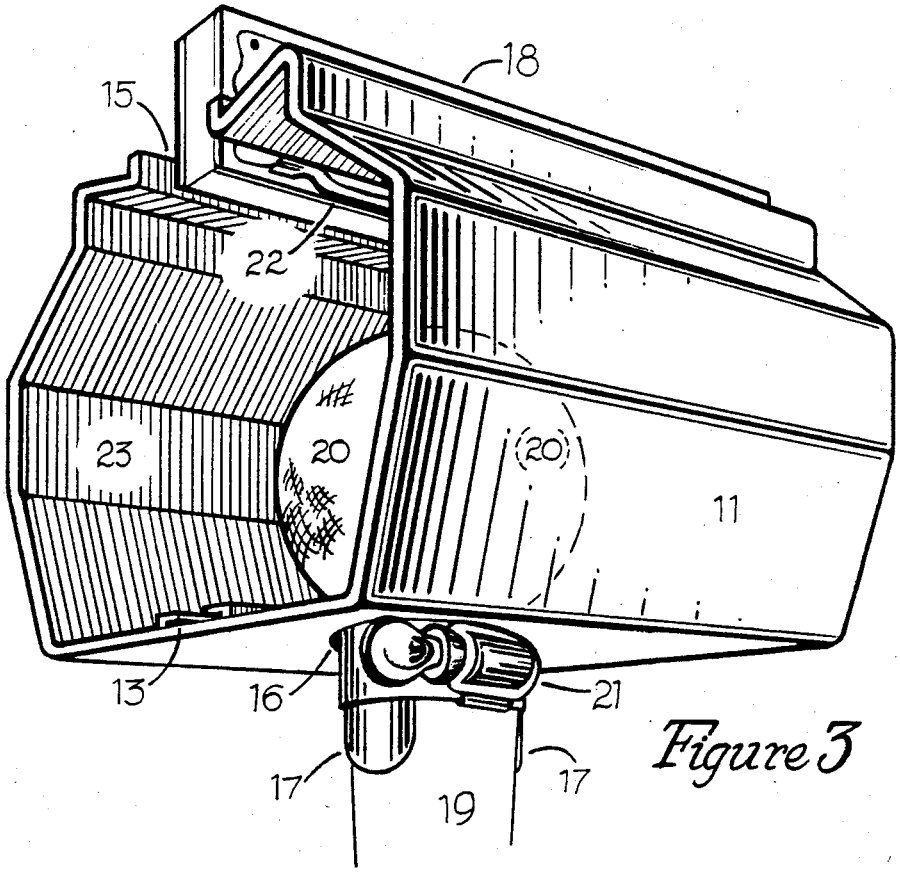
FIG. 3 and FIG. 4 show the entire harmonica-to-microphone assembly and the details thereof.
Figure 4:
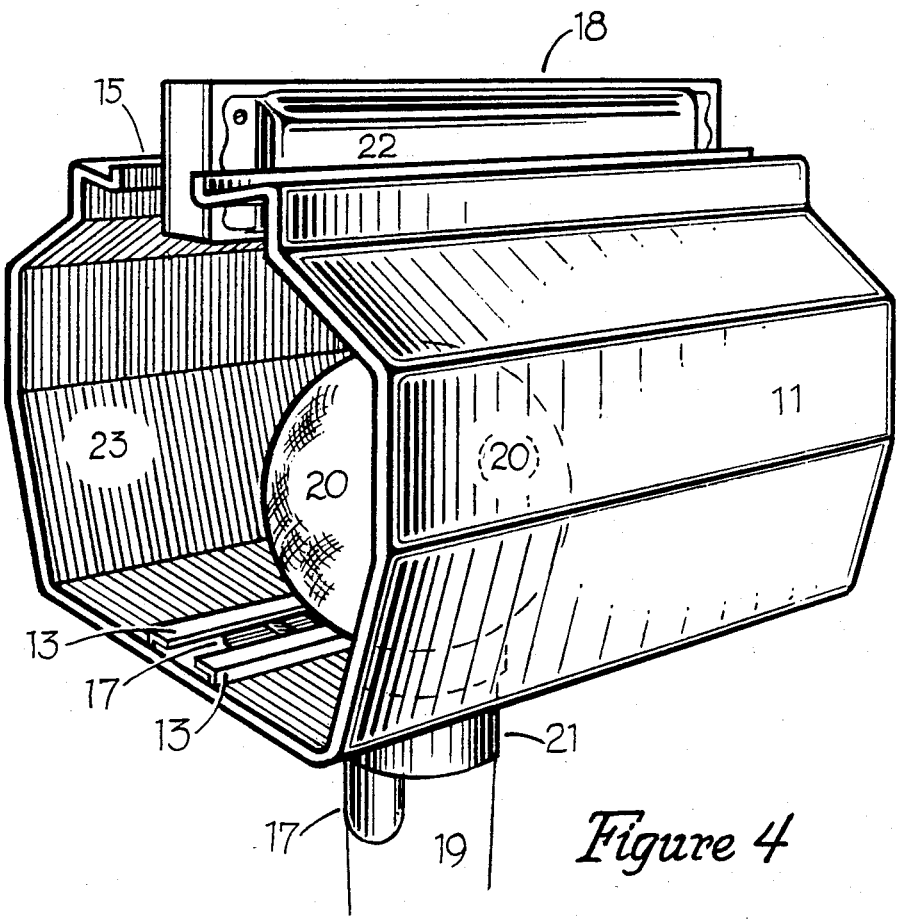

Referring now in greater detail to the various views of the drawing; FIG. 1 is an orthographic end view of the invention showing the clamping side walls 11, which in conjunction with the central base wall 14, provides for a hollow interior 12 which is open at both ends 12. Also present are microphone-mounting-braces clamps 13, which extend lengthwise as part of the inside surface of the central base wall 14. Each clamping side wall 11 terminates as a harmonica-clamping edge 15, between which harmonica-clamping edges is formed a narrow opening which extends the full length of the harmonica-clamping edges 15. The harmonica-clamping edges 15, the clamping side walls 11, the central base wall 14, and the microphone-mounting-brace clamps 13 are formed preferably from a single extrusion or other process molding of sturdy but slightly flexible plastic, such as a polyvinyl or other variety common to commerce. In FIG. 2 it is seen that through the central base wall 14 is formed a microphone insertion opening 16, through which microphone insertion opening 16 two generally L-shaped microphone-mounting braces 17 are inserted, one each into each pair of microphone-mounting-brace clamps 13 on each of two opposite sides of the microphone insertion opening 16. The L-shaped microphone-mounting braces 17 are corrugated on one end to provide for greater gripping strength when inserted into the microphone-mounting-brace clamps 13. The microphone-mounting braces are formed preferably from a variety of strapping metal common to commerce or from similar material which can be stamped or otherwise formed into the desired shape. As is seen in FIG. 3 and FIG. 4, the handle of a microphone 19 is receivable via either open end of the hollow inner space 12 through the microphone insertion opening 16 and is in turn receivable between the microphone-mounting braces 17. An adjustable clamping sleeve 21 is receivable over the microphone-mounting braces with the handle of the microphone 19 secured therebetween. A harmonica 18 can be inserted into the slot between the harmonica-clamping edges 15. Also shown in FIG. 3 and FIG. 4, the sensing device of the microphone 20 and the resonating chambers 22 of the harmonica 18 are held together in close proximity within the reflective inside surface 23 of the clamping side walls 11 and the central base wall 14, 11. Further, the clamping side walls 11 and the central base wall 14 form a wind shield to prevent the noises of nasal exhalation from reaching the microphone sensing device 20.

The entire harmonica-to-microphone assembly, depicted in FIG. 3 and FIG. 4, can be hand-held when so desirable to the musician using the device or, at the user's option, the entire harmonica-to-microphone assembly can, as is illustrated in FIG. 5, FIG. 6, FIG. 7 and FIG. 8, by way of the handle of the microphone 19, be fitted into and held securely by whatever microphone holder 24 and microphone stand assembly 30 is common to commerce and accommodates the microphone 19, to which the user attaches the present invention and a harmonica as is illustrated in FIGS. 2, 3, and 4 and described above.

Further, FIGS. 5, 6, 7 and 8 illustrate how the user of the present invention can control the setting of whatever mouth-to-harmonica alignment is preferred by the user. As is seen in FIG. 5, the horizontal axis of the attached harmonica 18 has the potential of being pivoted 360 degrees in either direction 27 by simply pivoting the microphone 19 inside the sleeve 25 of the microphone holder 24 and, thus the entire harmonica-to-microphone assembly is pivoted, which pivotability of microphones inside the sleeves of microphone holders is the standard nature of virtually all relationships between microphones and the accompanying microphone holders as are common to commerce.

FIG. 6 and FIG. 8 illustrate that the left-to-right pivoting 28 of the harmonica-to-microphone assembly is available by simply pivoting the microphone stand; either the entire stand assembly 30 either to the right or left, or as is possible with most microphone stand varieties as are common to commerce, by pivoting the upper rod 31 only of the microphone stand assembly 30. Seen in FIG. 7 and FIG. 8, the vertical axis 29 can be adjusted an approximate 180 degrees up and down by simply tilting the microphone in the microphone holder 24 at the microphone holder pivoting screw 26; which up and down tilting of microphones is the standard nature and intended use of virtually all microphone holders 24 as are common to commerce. The raising and lowering of the overall height of the microphone stand 30 is the natural and intended use of virtually all microphone stand assemblies 30 of the varieties common to commerce which are designed for vocal or general purpose application; which raising and lowering of height, combined with the pivot point adjustments, as are previously described herein, and the use of the present invention of a harmonica-to-microphone assembly will provide the user of the present invention with extensive flexibility in the establishing of whatever mouth-to-harmonica alignment is preferred by the user.

While the present invention as described herein is presented in conjunction with a preferred embodiment, the foregoing is considered as illustrative only of the principles of the invention and is not intended to limit the invention to the exact construction and embodiment described. Further, it can be assumed that suitable modifications and changes may be made by those skilled in the art without departing from the scope and nature of this invention which is defined in the following claims.

As my invention I hereby claim as new:

1. A harmonica support clamp for attaching a harmonica to a microphone and a microphone support stand comprising:

two parallel juxtaposed harmonica clamping edges, each said edge being a continuation of a clamping side wall, the two clamping side walls being supported by and a continuation of a common central base wall;

said base wall having in it a microphone insertion opening comprising an aperture;

a pair of microphone mounting brace clamps, each clamp comprising a pair of parallel flanges forming a channel on said base wall, each channel extending radially from an edge of said aperture;

and two L-shaped microphone mounting braces, a portion of each brace being inserted into a respective one of said channels from an end of said channel adjacent an edge of said aperture, a remaining portion of each of said braces extending away from said base wall.

2. The device of claim 1 in which said harmonica clamping edges, said clamping side walls, said common central base wall, and said microphone mounting brace clamps are formed from a single integral piece of semi-flexible plastic.

3. The device of claim 1 in which the portion of each said brace inserted into its respective channel is corrugated.

* * * * *